US006249757B1

(12) United States Patent
Cason

(10) Patent No.: US 6,249,757 B1
(45) Date of Patent: Jun. 19, 2001

(54) SYSTEM FOR DETECTING VOICE ACTIVITY

(75) Inventor: David G. Cason, Grass Valley, CA (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/250,685

(22) Filed: Feb. 16, 1999

(51) Int. Cl.[7] ..... G10L 11/06

(52) U.S. Cl. ..... 704/214; 704/226; 370/289; 379/409; 379/410

(58) Field of Search ..... 704/233, 226, 704/214; 370/289; 379/409, 410

(56) References Cited

U.S. PATENT DOCUMENTS

| | | | | |
|---|---|---|---|---|
| 4,531,228 | | 7/1985 | Noso et al. | 381/46 |
| 4,696,039 | * | 9/1987 | Doddington | 381/46 |
| 4,982,341 | | 1/1991 | Laurent | 369/517 |
| 5,550,924 | | 8/1996 | Helf et al. | 381/94 |
| 5,587,998 | * | 12/1996 | Velardo, Jr. et al. | 370/289 |
| 5,737,407 | | 4/1998 | Graumann | 379/389 |
| 5,774,847 | * | 6/1998 | Chu et al. | 704/237 |
| 5,844,494 | | 12/1998 | Spahlinger et al. | 340/677 |
| 5,844,994 | | 12/1998 | Graumann | 381/56 |
| 6,006,108 | * | 12/1999 | Black et al. | 455/553 |

OTHER PUBLICATIONS

Rabiner, L.R. and Schafer, R.W. AT&T Digital Processing of Speech Signals. pp. 130–135. Prentice–Hall, Inc. 1978.
Rabiner, L.R. and Shafer, R.W. AT&T Digital Processing of Speech Signals. pp. 462–505. Prentice–Hall, Inc. 1978.
Recommendation GSM 06.32. Voice Activity Detection. Feb., 1992.

* cited by examiner

*Primary Examiner*—William R. Korzuch
*Assistant Examiner*—Susan McFadden
(74) *Attorney, Agent, or Firm*—McDonnell, Boehnen, Hulbert & Berghoff

(57) ABSTRACT

A system for detection of voice activity in a communications signal, employing a nonlinear two filter voice detection algorithm, in which one filter has a low time constant (the fast filter) and one filter has a high time constant (the slow filter). The slow filter serves to provide a noise floor estimate for the incoming signal, and the fast filter serves to more closely represent the total energy in the signal. The absolute value of incoming data is presented to both filters, and the difference in filter outputs is integrated over each of a series of successive frames, thereby giving an indication of the energy level above the noise floor in each frame of the incoming signal. Voice activity is detected if the measured energy level for a frame exceeds a specified threshold level. Silence (e.g., leaving only noise) is detected if the measured energy level for each of a specified number of successive frames does not exceed a specified threshold level. The system enables voice activity to be distinguished from common noise such as pops, clicks and low level cross-talk.

18 Claims, 2 Drawing Sheets

SYSTEM FOR DETECTING VOICE ACTIVITY

BACKGROUND OF THE INVENTION

1. Field of the Invention

The present invention relates to telecommunications systems and more particularly to a mechanism for detecting voice activity in a communications signal and for distinguishing voice activity from noise, quiescence or silence.

2. Description of Related Art

In telecommunications systems, a need often exists to determine whether a communications signal contains voice or other meaningful audio activity (hereafter referred to as "voice activity" for convenience) and to distinguish such voice activity from mere noise and/or silence. The ability to efficiently draw this distinction is useful in many contexts.

As an example, a digital telephone answering device (TAD) will typically have a fixed amount of memory space for storing voice messages. Ideally, this memory space should be used for storing only voice activity, and periods of silence should be stored as tokens rather than as silence over time. Unfortunately, however, noise often exists in communications signals. For instance, a signal may be plagued with low level cross-talk (e.g., inductive coupling of conversations from adjacent lines), pops and clicks (e.g., from bad lines), various background noise and/or other interference. Since noise is not silent, a problem exists: in attempting to identify silence to store as a token, the TAD may interpret the line noise as speech and may therefore store the noise notwithstanding the absence of voice activity. As a result, the TAD may waste valuable memory space.

As another example, in many telecommunications systems, voice signals are encoded before being transmitted from one location to another. The process of encoding serves many purposes, not the least of which is compressing the signal in order to conserve bandwidth and to therefore increase the speed of communication. One method of compressing a voice signal is to encode periods of silence or background noise with a token. Similar to the example described above, however, noise can unfortunately be interpreted as a voice signal, in which case it would not be encoded with a token. Hence, the voice signal may not be compressed as much as possible, resulting in a waste of bandwidth and slower (and potentially lower quality) communication.

As still another example, numerous applications now employ voice recognition technology. Such applications include, for example, telephones with voice activated dialing, voice activated recording devices, and various electronic device actuators such as remote controls and data entry systems. By definition, such applications require a mechanism for detecting voice and distinguishing voice from other noises. Therefore, such mechanisms can suffer from the same flaw identified above, namely an inability to sufficiently distinguish and detect voice activity.

A variety of speech detection systems currently exist. One type of system, for instance, relies on a spectral comparison of the communications signal with a spectral model of common noise or speech harmonics. An example of one such system is provided by the GSM 6.32 standard for mobile (cellular) communications promulgated by the Global System for Mobile Communications. According to GSM 6.32, the communications signal is passed through a multi-pole filter to remove typical noise frequency components from the signal. The coefficients of the multi-pole filter are adaptively established by reference to the signal during long periods of noise, where such periods are identified by spectral analysis of the signal in search of fairly static frequency content representative of noise rather than speech. Over each of a sequence of frames, the energy output from the multi-pole filter is then compared to a threshold level that is also adaptively established by reference to the background noise, and a determination is made whether the energy level is sufficient to represent voice.

Unfortunately, such spectral-based voice activity detectors necessitate complex signal processing and delays in order to establish the filter coefficients necessary to remove noise frequencies from the communication signal. For instance, with such systems it becomes necessary to establish the average pole placement over a number of sequential frames and to ensure that those poles do not change substantially over time. For this reason, the GSM standard looks for relatively constant periodicity in the signal before establishing a set of filter coefficients.

Further, any system that is based on a presumption as to the harmonic character of noise and speech is unlikely to be able to distinguish speech from certain types of noise. For instance, low level cross-talk may contain spectral content akin to voice and may therefore give rise to false voice detection. Further, a spectral analysis of a signal containing low level cross-talk could cause the GSM system to conclude that there is an absence of constant noise. Therefore, the filter coefficients established by the GSM system may not properly reflect the noise, and the adaptive filter may fail to eliminate noise harmonics as planned. Similarly, pops and clicks and other non-stationary components of noise may not fit neatly into an average noise spectrum and may therefore pass through the adaptive filter of the GSM system as voice and contribute to a false detection of voice.

Another type of voice detection system, for instance, relies on a combined comparison of the energy and zero crossings of the input signal with the energy and zero crossings believed to be typical in background noise. As described in Lawrence R. Rabiner & Ronald W. Schafer, Digital Processing of Speech Signals 130–135 (Prentice Hall 1978), this procedure may involve taking the number of zero crossings in an input signal over a 10 ms time frame and the average signal amplitude over a 10 ms window, at a rate of 100 times/second. If over the first 100 ms, it is assumed that the signal contains no speech, then the mean and standard deviation of the average magnitude and zero crossing rate for this interval should give a statistical characterization of the background noise. This statistical characterization may then be used to compute a zero-crossing rate threshold and an energy threshold. In turn, average magnitude profile zero-crossing rate profiles of the signal can be compared to the threshold to give an indication of where the speech begins and ends.

Unfortunately, however, this system of voice detection relies on a comparison of signal magnitude to expected or assumed threshold levels. These threshold levels are often inaccurate and can give rise to difficulty in identifying speech that begins or ends with weak frickatives (e.g., "f", "th", and "h" sounds) or plosive bursts (e.g., "p", "t" or "k" sounds), as well as distinguishing speech from noise such as pops and clicks. Further, while an analysis of energy and zero crossings may work to detect speech in a static sound recording, the analysis is likely to be too slow and inefficient to detect voice activity in real-time media streams.

In view of the deficiencies in these and other systems, a need exists for an improved mechanism for detecting voice activity and distinguishing voice from noise or silence.

SUMMARY OF THE INVENTION

The present invention provides an improved system for detection of voice activity. According to a preferred embodiment, the invention employs a nonlinear two-filter voice detection algorithm, in which one filter has a low time constant (the fast filter) and one filter has a high time constant (the slow filter). The slow filter can serve to provide a noise floor estimate for the incoming signal, and the fast filter can serve to more closely represent the total energy in the signal.

A magnitude representation of the incoming data may be presented to both filters, and the difference in filter outputs may be integrated over each of a series of successive frames, thereby providing an indication of the energy level above the noise floor in each frame of the incoming signal. Voice activity may be identified if the measured energy level for a frame exceeds a specified threshold level. On the other hand, silence (e.g., the absence of voice, leaving only noise) may be identified if the measured energy level for each of a specified number of successive frames does not exceed a specified threshold level.

Advantageously, the system described herein can enable voice activity to be distinguished from common noise such as pops, clicks and low level cross-talk. In this way, the system can facilitate conservation of potentially valuable processing power, memory space and bandwidth.

These as well as other advantages of the present invention will become apparent to those of ordinary skill in the art by reading the following detailed description, with appropriate reference to the accompanying drawings.

BRIEF DESCRIPTION OF THE DRAWINGS

A preferred embodiment of the present invention is described herein with reference to the drawings, in which.

DETAILED DESCRIPTION OF THE PREFERRED EMBODIMENT

Figure 1:
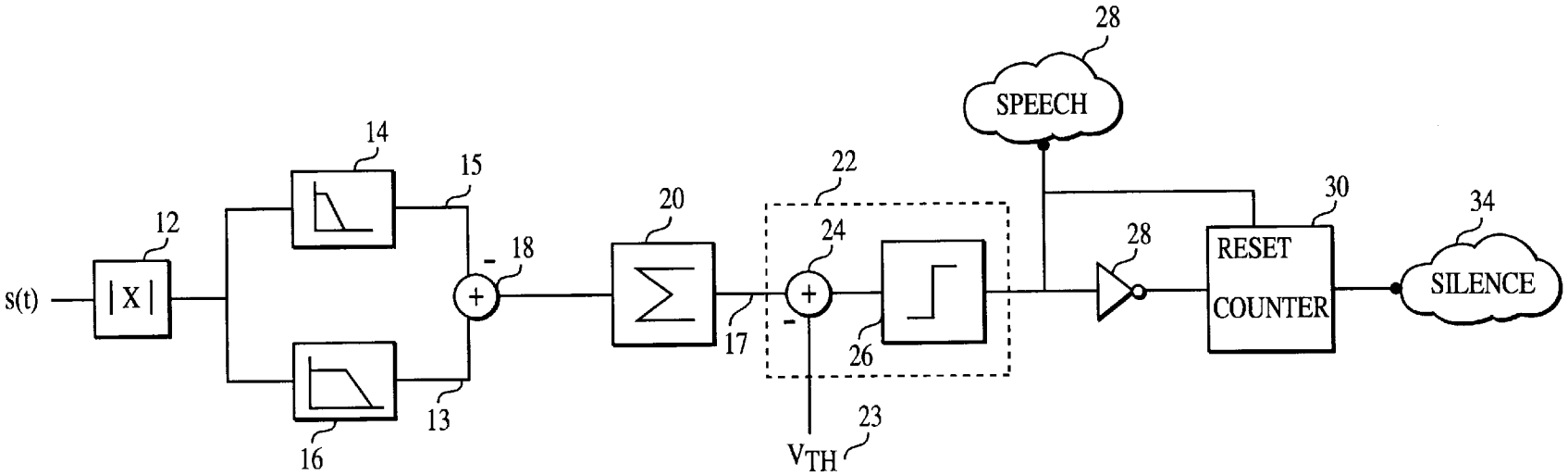
FIG. 1 is a block diagram illustrating the process flow in a voice activity detection system operating in accordance with a preferred embodiment of the present invention.

Referring to the drawings, FIG. 1 is a functional block diagram illustrating the operation of voice activity detector in accordance with a preferred embodiment of the present invention. The present invention can operate in the continuous time domain or in a discrete time domain. However, for purposes of illustration, this description assumes initially that the signal being analyzed for voice activity has been sampled and is therefore represented by a sequence of samples over time.

Figure 2:
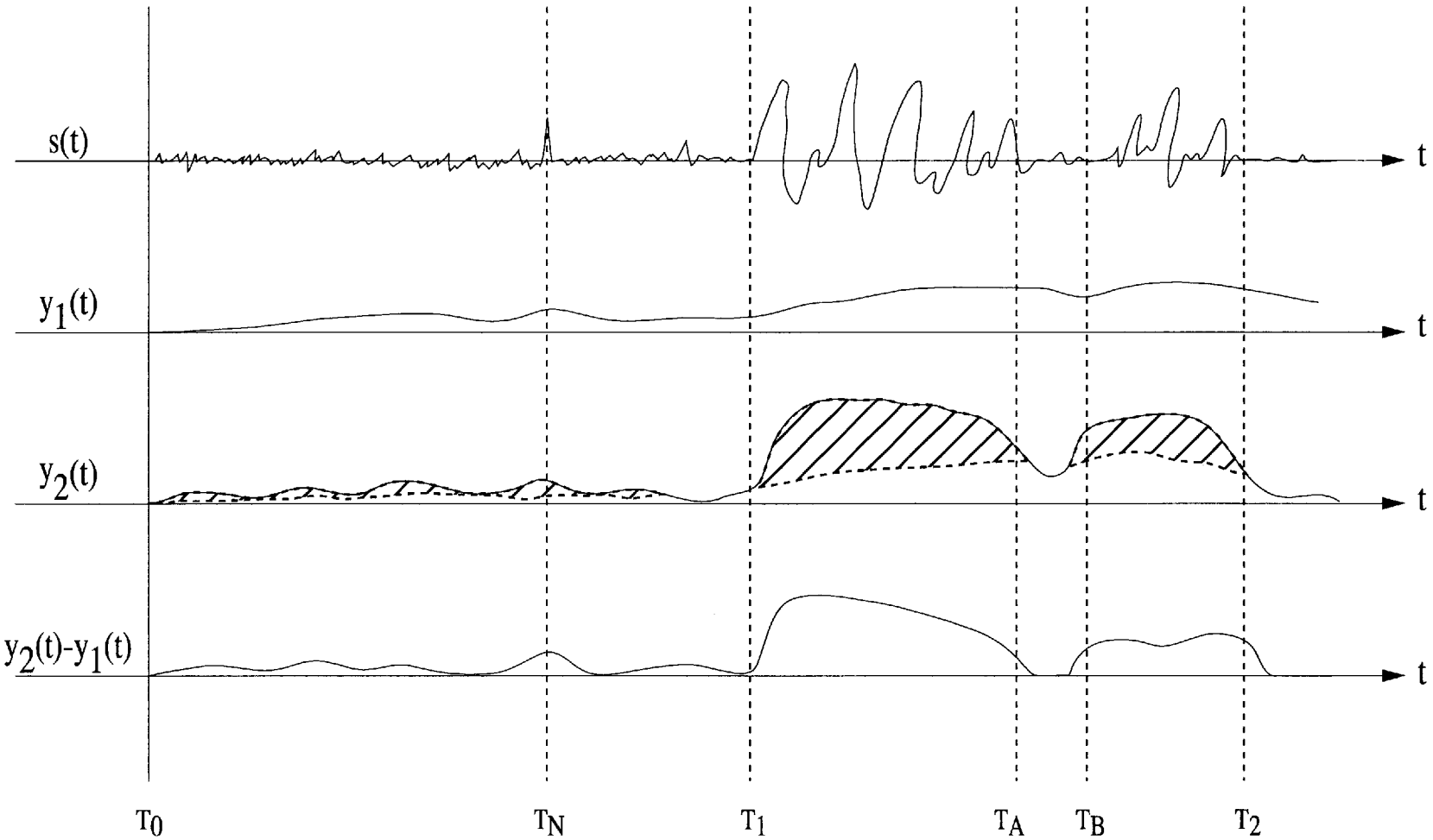
FIG. 2 is a set of graphs illustrating signals flowing through a voice activity detection system operating in accordance with a preferred embodiment of the present invention.

FIG. 2 depicts a timing chart showing a continuous time representation an exemplary signal s(t). This signal may be a representation (e.g., an encoded form) of an underlying communications signal (such as a speech signal and/or other media signal) or may itself be a communications signal. For purposes illustration, from time $T_0$ to $T_1$, the signal is shown as limited to noise of a relatively constant energy level, except for a spike (e.g., a pop or click) at time $T_N$. Beginning at time $T_1$, and through time $T_2$, the signal is shown to include voice activity. Consequently, at time $T_1$, the energy level in the input signal quickly increases, and at time $T_2$, the energy level quickly decreases. During the course of the voice activity, there may naturally be pauses and variations in the energy level of the signal, such as the exemplary pause illustrated between times $T_A$ and $T_B$. Further, although not shown in the timing chart, exemplary signal s(t) will continue to contain noise after time $T_1$. Since this noise is typically low in magnitude compared to the voice activity, the noise waveform will slightly modulate the voice activity curve.

According to a preferred embodiment, at rectifier block 12 in FIG. 1, the input signal is first rectified, in order to efficiently facilitate subsequent analysis, such as comparison of relative waveform magnitudes. In the preferred embodiment, rectifying is accomplished by taking the absolute value of the input signal. Alternatively, rather than or in addition to taking the absolute value, the signal may be rectified by other methods, such as squaring for instance, in order to produce a suitable representation of the signal. In this regard, the present invention seeks to establish a relative comparison between the level of the input signal and the level of noise in the input signal. Squaring the signal would facilitate a comparison of power levels. However, since only a relative comparison is contemplated, a sufficient comparison can be made simply by reference to the energy level of the signal. Further, while squaring is possible, it is not preferable, since squaring is a computationally more complex operation than taking an absolute value.

Referring next to blocks 14 and 16, the rectified signal is preferably fed through two low pass filters or integrators, each of which serve to estimate an energy level of the signal. According to the preferred embodiment, one filter has a relatively high time constant or narrow bandwidth, and the other filter has a relatively low time constant or wider bandwidth. The filter with a relatively high time constant will be slower to respond to quick variations (e.g., quick energy level changes) in the signal and may therefore be referred to as a slow filter. This filter is shown at block 14. The filter with a relatively low time constant will more quickly respond to quick variations in the signal and may therefore be referred to as a fast filter. This filter is shown at block 16.

These filters may take any suitable form, and the particular form is not necessarily critical to the present invention. Both filters may be modeled by the same algorithm (with effectively different time constants), or the two filter models may differ. By way of example and without limitation, each filter may simply take the form of a single-pole infinite impulse response filter (IIR) with a coefficient $\alpha$, where $\alpha<1$, such that the filter output y(n) at a given time n is given by:

$$y(n)=y(n-1)(1-\alpha)+|s(n)|(\alpha).$$

As the time constant in this filter goes down, $\alpha$ goes down, and as the time constant goes up, $\alpha$ goes up. Thus, with a small time constant, the output of the slow filter in response to each new sample (or other new signal information) will be weighed more heavily in favor of the previous output and will not readily respond to the new information. In contrast, with a large time constant, the output of the fast filter in response to each new sample will be weighed more heavily in favor of the new sample and will therefore more closely track the input signal.

Referring to the timing charts of FIG. 2, the output from the slow filter is shown as output signal $y_1(t)$ and the output from the fast filter is shown as output signal $y_2(t)$. For purposes of comparison in this example, the output of the slow filter is also shown in shadow in the chart of output $y_2(t)$, and the difference between outputs $y_2(t)$ and $y_1(t)$ is shown cross-hatched as well. Finally, as will be explained below, the positive difference between outputs $y_2(t)$ and $y_1(t)$ is shown in the last chart of FIG. 2.

As illustrated by FIG. 2, the output $y_1(t)$ of the slow filter gradually builds up (or down) over time to a level that represents the average energy in the rectified signal. Thus, from time $T_0$ to time $T_1$, for instance, the slow filter output becomes a roughly constant, relatively long lasting estimate of the average noise energy level in the signal. As presently contemplated, this average noise level at any given time may serve as a noise floor estimate for the signal. The occurrence of a single spike at time $T_N$, for example, may have very little effect on the output of the slow filter, since the high time constant of the slow filter preferably does not allow the filter to respond to such quick energy swings, whether upward or downward. Beginning at or just after time $T_1$, the output of the slow filter will similarly begin to slowly increase to the average energy level of the combined noise and voice signal (rectified), only briefly decreasing during the pause in speech at time period $T_A$ to $T_B$. Of course, provided with a higher time constant, the slow filter output will take more time to change.

As further illustrated by FIG. 2, the output $y_2(t)$ of the fast filter is much quicker than the slow filter to respond to energy variations in the rectified signal. Therefore, from time $T_0$ to $T_1$, for instance, the fast filter output may become a wavering estimate of the signal energy, tracking more closely (but smoothly as an integrated average) the combined energy of the rectified signal (e.g., including any noise and any voice). The occurrence of the spike at time $T_N$, for example, may cause momentary upward and downward swings in the fast filter output $y_2(t)$. Beginning at or just after time $T_1$, in response to the start of voice activity, the output $y_2(t)$ of the fast filter may quickly increase to the estimated energy level of the rectified signal and then track that energy level relatively closely. For instance, where the voice activity momentarily pauses at time $T_A$, the fast filter output will dip relatively quickly to a low level, and, when the voice activity resumes at time $T_B$, the fast filter output will increase relatively quickly to again estimate the energy of the rectified signal.

The time constants of the slow and fast filters are matters of design choice. In general, the slow filter should have a large enough time constant (i.e., should be slow enough) to avoid reacting to vagaries and quick variations in speech and to provide a relatively constant measure of a noise floor. The fast filter, on the other hand, should have a small enough time constant (i.e., should be fast enough) to react to any signal that could potentially be considered speech and to facilitate a good measure of an extent to which the current signal exceeds the noise floor. Experimentation has established, for example (and without limitation), that suitable time constants may be in the range of about 4 to 16 seconds for the slow filter and in the range of about 16 to 32 milliseconds for the fast filter. As a specific example, the slow filter may have a time constant of 8 seconds, and the fast filter may have a time constant of 16 milliseconds.

According to the preferred embodiment, the output of the slow filter 15 is subtracted from the output of the fast filter 13, as shown by the adder circuit of block 18 in FIG. 1. This resulting difference is indicated by the cross-hatched shading in the chart of $y_2(t)$ in FIG. 2. Because the output of the slow filter 15 output generally represents a noise floor and the output of the fast filter 13 represents the signal energy, the difference between these two filter outputs (measured on a sample-by-sample basis, for instance) should generally provide a good estimate of the degree by which the signal energy exceeds the noise energy.

In theory, it is possible to continuously monitor the difference between the filter outputs in search of any instance (e.g., any sample) in which the difference rises above a specified threshold indicative of voice energy. The start of any such instance would provide an output signal indicating the presence of voice activity in the signal, and the absence of any such instance would provide an output signal indicating the absence of voice activity in the signal. Such a mechanism, however, will be unlikely to be able to differentiate between voice activity and common types of noise such as pops, clicks and squeaks. A sudden pop, for instance, may be large in magnitude and may therefore rise substantially above the estimated noise floor. Consequently, the difference in filter outputs would exceed the voice activity threshold, and the system would characterize the pop as voice, thereby leading to problems such as those described above in the background section.

As presently contemplated, improved voice activity detection can be achieved by integrating (i.e., summing) the difference between filter outputs over a particular time period and determining whether the total integrated energy over that time period exceeds a specified threshold energy level that is indicative of voice activity. The idea here is to ensure that the system is not tricked into characterizing some types of noise as voice activity. For example, noise in the form of a pop or click typically lasts only a brief moment. When the difference between filter outputs is integrated over a specified time period, the energy level of such noise should preferably not rise to the threshold level indicative of voice activity. As another example, noise in the form of low level cross talk, while potentially long lasting, is by definition low in energy. Therefore, when the difference between filter outputs is integrated over a specified time period, the energy level of such noise should also preferably not rise to the threshold level indicative of voice activity. In response to true speech, on the other hand, the difference between filter outputs integrated over the specified time period should rise to the level indicative of voice activity.

Hence, according to the preferred embodiment, the output from the adder block 18 is preferably summed over successive time frames $T_F$ to produce for each time frame a reference value 17 that can be measured against a threshold value. Referring to FIG. 1, this summation is shown at block 20. Block 20 may take any suitable form. As an example, without limitation, block 20 may be an integrate and dump circuit, which sums the differences over each given time frame $T_F$ and then clears its output in preparation to sum over the next time frame. One way to implement this integrate and dump circuit, for instance, is to employ a simple op-amp with a feedback capacitor that charges over each time $T_F$ and is discharged through a shunt switch at the expiration of time $T_F$.

The time frame $T_F$ represents a block of the communications signal and may also be any desired length. As those of ordinary skill in the art will appreciate, however, communications signals are often already encoded (i.e., represented) and/or transmitted in blocks or frames of time. For example, according to the G.723.1 vocoder standard promulgated by the International Telecommunications Union (ITU), a 16 bit PCM representation of an analog speech signal is partitioned into consecutive segments of 30 ms length, and each of these segments is encoded as a frame of 240 samples. Similarly, according to the GSM mobile communications standard mentioned above, a speech signal is parsed into consecutive segments of 20 ms each.

According to the preferred embodiment, the time frame $T_F$ over which the difference between the fast and slow filter outputs is integrated may, but need not necessarily, be defined by the existing time segments of the underlying codec. Thus, for instance, in applying the present invention to detect voice activity in a G.723.1 data stream, the time frame $T_F$ is preferably 30 ms or some multiple of 30 ms. Similarly, in applying the present invention to detect voice activity in a GSM data stream, the time $T_F$ is preferably 20 ms or some multiple of 20 ms. Since the existing time segments of the underlying codec themselves define blocks of data to be processed (e.g., decoded), the additional analysis of those segments as contemplated by the present invention is both convenient and efficient.

Of course, the time frame $T_F$ itself is a matter of design choice and may therefore differ from the frame size employed by the underlying codec (if any). The time frame $T_F$ may be established based on any or a combination of factors, such as the desired level of sensitivity, the time constants of the fast and slow filters, knowledge of speech energy levels generally, empirical testing, and convenience. For instance, those skilled in the art will appreciate that humans cannot detect speech that lasts for less than 20 ms. Therefore, it may make sense to set the time frame $T_F$ to be 20 ms, even if the underlying codec employs a different time frame. Further, it will be appreciated that, instead of analyzing separate and consecutive time blocks of length $T_F$, the time frame $T_F$ may be taken as a sliding window over the course of the signal being analyzed, such that each subsequent time frame of analysis incorporates some portion of the previous time frame as well. Still further, although $T_F$ is preferably static for each time frame, such that each time frame is the same length, the present invention can extend to consideration of time frames of varying size if desired.

For each time frame $T_F$, the sum computed at block 20 is preferably compared to an appropriate voice activity threshold level $V_{TH}$ 23, as shown at comparator block 22, and an output signal is produced. In the preferred embodiment, this output indicates either that voice activity is present or not. For purposes of reference, an output that indicates that voice activity is present may be called "speech indicia," and an output that indicates that voice activity is not present may be called "quiescence indicia." In this regard, "quiescence" is understood to be the absence of speech, whether momentarily or for an extended duration. In a digital processing system, for instance, the speech indicia may take the form of a unit sample or one-bit, while the quiescence indicia may take the form of a zero-bit.

The comparator of block 22 may take any suitable form, the particulars of which are not necessarily critical. As an example, the comparator may include a voltage offset block 24 and a limiter block 26 as shown in FIG. 1. The voltage offset block 24 may subtract from the output of block 20 the threshold level $V_{TH}$ 23, and the limiter block 26 may then output (i) speech indicia if the difference is greater than zero or (ii) quiescence indicia if the difference is not greater than zero. Thus, in a digital processing system, for instance, if the output of block 20 meets or exceeds $V_{TH}$ 23, the comparator may output a one-bit, and if the output of block 20 is less than $V_{TH}$ 23, the comparator may output a zero-bit.

The particular threshold level $V_{TH}$ 23 employed in this determination is a matter of design choice. In the preferred embodiment, however, the threshold level should represent a minimum estimated energy level needed to represent speech. Like the time frame $T_F$, the threshold value may be set based on any or a combination of a variety of factors. These factors include, for instance, the desired level of sensitivity, the time constants of the fast and slow filters, knowledge of speech energy levels generally, and empirical testing.

In response to voice activity, the preferred embodiment thus outputs speech indicia. As shown in FIG. 1, this speech indicia is indicated by block 28, as an output from comparator 28. In a digital processing system, for instance, this output may be a one-bit. A device or system employing the present invention can use this output as desired. By way of example, without limitation, a digital TAD may respond to speech indicia by starting to record the input communications signal. As another example, a speech encoding system may respond to speech indicia by beginning to encode the input signal as speech.

In accordance with the preferred embodiment, quiescence indicia is handled differently than speech indicia. In this regard, it is well known that human speech naturally contains momentary pauses or moments of quiescence. In many cases, it would be best not to categorize such pauses in speech as silence (i.e., as an absence of speech, leaving only noise for instance), since doing so could make the speech signal sound unnatural. For example, if a digital TAD records momentary pauses in conversational speech with tokens representing silence, the resulting speech signal may sound choppy or distorted. In the preferred embodiment, this problem can be avoided by requiring a long enough duration of quiescence before concluding that speech is in fact absent.

To ensure a long enough duration of quiescence before concluding that silence is present, the output of comparator 22 can be used to control a counter, which measures whether a sufficient number of time frames $T_F$ of quiescence have occurred. Such a counter is illustrated as block 30 in FIG. 2, where the counter clock may be provided by successive frame boundaries. For example, each null or zero output from comparator 22 (exemplary quiescence indicia for a time frame $T_F$) can be inverted and then input to a counter in order to increment the counter. When the counter indicates that a sufficient number of successive time frames $T_F$ of quiescence have occurred, the counter may output a signal indicating so. Alternatively, a comparator or other element may monitor the count maintained by counter 30 and may output a signal when sufficient quiescence frames have occurred. In either case, this output may be referred to as "silence indicia" and is shown by way of example at block 34 in FIG. 2. In a digital processing system, for instance, this silence indicia may be output as a one-bit. In the preferred embodiment, speech indicia output from comparator 22 is used to reset the counter as shown in FIG. 1, since the detection of voice activity is contrary to a characterization of quiescence as silence.

The duration of quiescence (also referred to as "hangover time") considered sufficient to justify a conclusion that silence is present is a matter of design choice. By way of example and without limitation, quiescence for a duration of about 150 ms to 400 ms may be considered sufficient. Thus, for instance, the occurrence of 10 successive 20 millisecond time frames of quiescence may justify a conclusion that silence is present.

A device or system employing the present invention may use silence indicia as desired. For example, without limitation, a digital TAD may respond to silence indicia by beginning to record the communications signal as tokens representing silence, thereby conserving possibly valuable memory space. Similarly, a speech encoding system may respond to silence indicia by beginning to encode the input signal with silence tokens, thereby potentially conserving bandwidth and increasing the speed of communication.

As will be understood from a reading of this description and a review of the timing charts in FIG. 1, the output of slow filter 15 could generally continue to rise in the presence of fairly continuous voice activity, thereby approaching the average energy in the combined speech and noise signal. Momentary quiescence in the speech signal would not significantly affect the output of the slow filter. At some point, therefore, the outputs of the fast and slow filters could tend to meet, and the integrated difference between the filter outputs over a time frame $T_F$ would no longer be representative of the extent to which the energy level in the signal exceeds the noise floor.

In accordance with the preferred embodiment, this problem can be avoided by periodically resetting the output of the slow filter. The process of resetting the slow filter output can take any of a variety of forms. As one example, for instance, the slow filter output can be reduced periodically to a non-zero value based on some past slow filter output or can be set to zero. In the preferred embodiment, however, a robust solution can be provided by setting the slow filter output to be the output of the fast filter whenever the fast filter output drops to a level that is less than the slow filter output.

Because the fast filter output will more quickly respond to drops in the energy level of the input signal, it will tend to quickly decrease in response to moments of quiescence, which are natural in human speech and can therefore be expected. Provided with a steadily but slowly increasing output from the slow filter, the fast filter output may therefore fall below the slow filter output and quickly approach the remaining energy level in the signal, namely the noise energy level. Thus, when the fast filter output is less than the slow filter output, the fast filter output more accurately reflects the noise floor and can advantageously replace the slow filter output. As presently contemplated, this mechanism for resetting the slow filter output (i.e., the noise floor) can be accomplished by setting the slow filter output $y_2(t)$ to be the minimum of the slow filter output $y_2(t)$ and the fast filter output $y_1(t)$. Thus, as illustrated in FIG. 2, when the fast filter output drops below the slow filter output, the difference between the fast and slow filter outputs becomes zero.

The present invention can be carried out by appropriately configured analog circuitry and/or by a programmable or dedicated processor running an appropriate set of machine language instructions (e.g., compiled source code) stored in memory or other suitable storage medium. Those or ordinary skill in the art will be able to readily prepare such circuitry and/or code, provided with the foregoing description. In addition, although the foregoing description of the preferred embodiment will enable a person of ordinary skill in the art to readily make and use the invention, a detailed assembly language listing for a Texas Instruments TMS320C54 DSP is included in Appendix A. The listing provides detailed information concerning the programming and operation of the present invention. Therefore, additional detailed features of the invention will become apparent from a review of the program.

Still further, to assist in an understanding of the code listing in Appendix A, the following is a pseudo-code listing, which explains the routines and functions included in the code.

```
*****************************************************************************
*          Pseudo-Code Listing                                              *
*          Copyright, David G. Cason, 3Com Corporation                      *
*****************************************************************************
VAD_DEMO_INIT
    zero out the fast & slow filters
    zero out the fast-slow difference integrator
    zero out the sample counter
    voice = FALSE
    silence = TRUE
    init the detector state var for silence
VAD_DEMO:
    get a sample from the mic & pass it through a dc blocking HPF.
    if (SILENCE)
        speaker output = 0
    else
        speaker output = input-dc
    update sample counter
    update fast/slow filters
    update the frame integrator with (fast-slow)
    if(!end_of_frame)
        quit
    else
    {
        if(frame_integrator-thresh > 0)
            {
SPEECH:                 reset vad_state HANG_TIME
                        voice = TRUE
                        turn speech LED on
                        goto VAD_RESET
            }
            else
            {
NOT_SPEECH:             decrement vad_state
                        if(vad_state > 0)
                            goto VAD_RESET
                        turn off speech LED (silence led already off)
                        voice = FALSE
                        if(VAD_STATE+HANG_TIME >= 0)      (did we wait enough frames ?)
                        goto VAD_RESET                    (wait for HANG_TIME frames)
```

-continued

```
SILENCE:
                                set vad_state for silence (constant negative value)
                                silence = TRUE
                                turn on silence LED
        }
    }
VAD_RESET:
    sample_count = frame_integrator = 0
    END
*****************************************************************************
```

A preferred embodiment of the present invention has thus been described herein. According to the preferred embodiment, the present invention advantageously provides a system (e.g., apparatus and/or method) for detecting voice activity. The system can efficiently identify the beginning and end of a speech signal and distinguish voice activity from noise such as pops, clicks and low level cross-talk. The system can thereby beneficially help to reduce processing burdens and conserve storage space and bandwidth.

With the benefit of the above description, those of ordinary skill in the art should understand that various individual elements of the preferred embodiment can be replaced with suitable alternatives and equivalents. It will thus be understood that changes and modifications may be made without deviating from the spirit and scope of the invention as claimed.

APPENDIX A

```
*****************************************************************************
*       Copyright 1998 David G. Cason, 3Com Corporation                     *
*****************************************************************************
*****************************************************************************
*       ROUTINE             VAD_DEMO                                        *
*       TABLE ADDRESS       8                                               *
*       Function            Run the voice activity detector.
*****************************************************************************
fast_tau            .equ    7           ; 16 mS time constant
slow_tau            .equ    0           ; 8 S time constant
FRAME_END           .equ    160         ; 20mS frame length
HIGH                .equ    1000h
LOW                 .equ    0
VOICE_LOW           .equ    0DFC0h
VOICE_HI            .equ    09FC0h
HANG_TIME           .equ    10          ; allow 200mS hangover before speech ends
SILENCE_HI          .equ    0CFC0h
SILENCE_THRESH      .equ    200h
SILENCE_WAIT        .equ    100         ; wait 2 sec. before declaring silence
IO PORT             .equ    0014h
VAD_DEMO_INIT:
    ld      voice,dp
    st      #0,*(fast_filt)
    st      #0,*(noise_floor)
    st      #0,*(vad_power)
    st      #0,*(vad_count)
    st      #-(SILENCE_WAIT+1),*(vad_state)
    st      #LOW,*(voice)
    st      #HIGH,*(silence)
    st      #SILENCE_HI,vad_temp
    portw   vad_temp,IO_PORT
    st      #VAD_DEMO,*(task_list) ; init task_list
    st      #NULL,*(task_list+1) ; end task list for VAD test
    ret
VAD_DEMO:
    pshm    st1
    ssbx    frct
    ssbx    sxm
    ssbx    ovm
    mvdm    vox_rx_ptr0,ar2         ; get mic input
    ld      #audio_in,dp
    ld      *ar2+,A
    mvmd    ar2 , vox_rx_ptr0
    stl     A,audio_in
    calld   NODC_AUDIO
    mvdm    vox_tx_ptr1,ar2
    ld      audio_in,B              ; put reference in B
CHECK_SILENCE:
    ld      #fast_filt,dp           ; set the data page
    cmpm    silence,#HIGH           ; Are we in silence ?
```

APPENDIX A-continued

```
    ld          B,A                         ; copy input to A
    abs         B                           ; B = |input|
    stl         B,vad_temp                  ; vad_temp = |input sample|
    xc          1,tc                        ; if we're in silence . . .
    xor         A,A                         ; zero out A
    st1         A,*ar2+                     ; store A in line tx buff
    mvmd        ar2,vox_tx_ptr1             ; update the pointer
    ld          #1,A
    add         vad_count,A                 ; inc frame sample count
    st1         A,vad_count
* calculate the input
    dld         fast_filt,A
    sub         fast_filt, (fast_tau),A     ; A = (1-fast_tau)*fast_filt
    add         B, (fast_tau),A             ; A = (1-fast_tau)*fast_filt +
                                            ; fast_tau*|input|
    dst         A,fast_filt
* calculate the noise floor
    dld         noise_floor,B
    sub         noise_floor,(slow_tau),B    ; B = (1-slow_tau)*noise_floor
    add         vad_temp,(slow_tau),B       ; B = (1-slow_tau)*noise_floor +
                                            ; slow_tau*|input|
    min         B                           ; A = fast_filt output B = min A or B
    dst         B,noise_floor               ; noise_floor <= fast_filt
    cmpm        vad_count,FRAME_END         ; check for frame end
*calculate speech power over the frame
    dld         fast_filt,A
    sub         B,A                         ; fast_filt-noise_floor = speech power
                                            estimate
    sfta        A,-2                        ; to avoid clipping at 7fff
    bcd         VAP_END,ntc                 ; is it frame end ?
    add         vad_power,16,A              ; update frame speech power estimate
    sth         A,vad_power
********************************** Frame end, declare VAD decision **************
    ld          vad_power,A
    sub         #SILENCE_THRESH,A           ; Is speech power > SILENCE_THRESH?
    bcd         NOT_SPEECH,alt
    ld          #-1,A
SPEECH:
    st          #HIGH,voice                 ; set voice variable
    st          #LOW,silence                ; reset silence variable
    st          #VOICE_HI,vad_temp
    portw       vad_temp,IO_PORT            ; update LEDS
    bd          VAD_RESET
    st          #HANG_TIME,vad_state        ; reset vad_state for voice
NOT_SPEECH:                                 ; failed speech . . . check for hangover time
    add         vad_state,A                 ; A = vad_state-1
    bcd         VAD_RESET,ageq              ; if vad_state > −1, keep going
    stl         A,vad_state                 ; update vad_state
    nop
VOICE_END:                                  ; hangover timeout
    st          #VOICE_LOW,vad_temp
    portw       vad_temp,IO_PORT            ; turn off voice LED
    add         #SILENCE_WAIT,A             ; have we waited SILENCE_WAIT frames yet?
    bcd         VAD_RESET,ageq              ; quit if not . . . else . . . we got silence
    st          #LOW,voice                  ; reset voice variable
SILENCE:
    st          #-(SILENCE_WAIT+1),vad_state ;      set vad_state for silence
    st          #HIGH,silence               ; set silence variable (voice already reset)
    st          #SILENCE_HI,vad_temp
    portw       vad_temp,IO_PORT            ; turn on silence LED
VAD_RESET:
    st          #0,vad_power
    st          #0,vad_count
VAD_END:
    popm        stl
    ret
*************************************Remove DC Component*******************************
NODC_AUDIO:
    ld          in,16,a                     ; load input
    sub         in,11,a                     ; acc = (1-beta/2)*in
    dsub        dc_est,a                    ; sub DC estimate
    sth         a,no_dc                     ; store output (sans dc)
    ld          a,-4,a                      ; acc=(in-DC estimate)*beta
    retd
    dadd        dc_est,a                    ; acc + DC estimate = DC estimate
    dst         a,dc_est                    ; update DC estimate
*****************************************************************************************
```

What I claim is:

1. A method for detecting voice activity in a communications signal comprising, in combination:

passing a representation of said communications signal through a first filter and a second filter, whereby the first filter provides a first output that represents a noise floor estimate for said communications signal, and whereby the second filter provides a second output that represents an energy level estimate for said communications signal;

integrating a difference between said first output and said second output over blocks of time, thereby establishing a reference value for each such block;

for each such block, determining whether said reference value represents voice activity;

outputting speech-indicia in response to a determination that said reference value represents voice activity; and outputting silence-indicia in response to a determination that the reference values established for each of a predetermined number of blocks do not represent voice activity.

2. A method as claimed in claim 1, further comprising resetting said first output to the lesser of said first output and said second output.

3. A method as claimed in claim 1, wherein the blocks of time are defined by a sliding window over time.

4. A method as claimed in claim 1, wherein the blocks of time comprise successive blocks of time.

5. A method for detecting voice activity in a communications signal comprising, in combination, the following steps:

receiving said communications signal;

rectifying said communications signal, thereby establishing a rectified signal;

passing said rectified signal through at least a first low-pass filter and a second low-pass filter, said first low-pass filter providing a slow filter output representing a noise floor in said rectified signal, and said second low pass filter providing a fast filter output representing an energy level in said rectified signal, whereby a difference between said fast filter output and said slow filter output at a given time defines a filter output difference at said given time;

over a block of time, integrating said filter output difference, thereby establishing a reference value for said block of time;

determining whether said reference value represents voice activity; and in response to a determination that said reference value represents voice activity, providing an output signal indicating that voice activity is present in said communication signal.

6. A method as claimed in claim 5, wherein determining whether said reference value represents voice activity comprises comparing said reference value to a threshold value indicative of voice activity.

7. A method as claimed in claim 5, further comprising setting said slow filter output to the lesser of said fast filter output and said slow filter output.

8. A method as claimed in claim 5, further comprising reducing said slow filter output to said fast filter output, in response to said fast filter output dropping below said slow filter output.

9. A method for detecting voice activity in a communications signal, said communications signal defining a plurality of successive frames, said method comprising, in combination:

(A) receiving as an input signal at least a plurality of said frames;

(B) rectifying said input signal, thereby establishing a rectified signal;

(C) passing said rectified signal through at least a first low-pass filter and a second low-pass filter, said first low-pass filter providing a slow filter output representing a noise floor in said communications signal, and said second low pass filter providing a fast filter output representing an energy level in said communications signal, whereby a difference between said fast filter output and said slow filter output at a given time defines a filter output difference at said given time;

(D) over each of a plurality of said frames, (i) integrating said filter output difference, thereby establishing a reference value for said frame, (ii) determining whether said reference value represents voice activity, (iii) in response to a determination that said reference value represents voice activity, providing a speech-indicia signal, and (iv) in response to a determination that said reference value does not represent voice activity, providing a quiescence-indicia signal; and (E) in response to more than a predetermined number of successive quiescence-indicia signals, providing a silence-indicia signal.

10. A system for detecting voice activity in a communications signal, said system comprising a processor and a set of machine language instructions stored in a storage medium and executed by said processor for performing a set of functions comprising, in combination:

passing a representation of said communications signal through a first filter and a second filter, whereby the first filter provides a first output that represents a noise floor estimate for said communications signal, and whereby the second filter provides a second output that represents an energy level estimate for said communications signal;

integrating a difference between said first output and said second output over blocks of time, thereby establishing a reference value for each such block;

for each such block, determining whether said reference value represents voice activity;

outputting speech-indicia in response to a determination that said reference value represents voice activity; and outputting silence-indicia in response to a determination that the reference values established for each of a predetermined number of blocks do not represent voice activity.

11. A system as claimed in claim 10, wherein said set of functions further comprises resetting said first output to the lesser of said first output and said second output.

12. A method as claimed in claim 10, wherein the blocks of time are defined by a sliding window over time.

13. A method as claimed in claim 10, wherein the blocks of time comprise successive blocks of time.

14. An apparatus for detecting voice activity in a communications signal comprising, in combination:

a rectifier for rectifying said signal, thereby providing a rectified signal;

a first filter for filtering said rectified signal and providing a first filter output representing a noise floor for said communications signal;

a second filter for filtering said rectified signal and providing a second filter output representing an energy level for said communications signal;

an integrator for summing the difference between said first filter output and said second filter output over each of a plurality of frames of said communications signal, thereby providing a sum for each such frame; and a comparator for determining whether said sum for a given frame exceeds a threshold value indicative of voice activity, whereby said apparatus finds voice activity in said communications signal in response to the sum for a given frame exceeding said threshold value.

15. An apparatus as claimed in claim 14, further comprising a counter for establishing a count of frames for which said sum does not exceed said threshold value, whereby said apparatus finds silence in said communications signal in response to said count reaching a specified value.

16. An apparatus as claimed in claim 14 further comprising means for resetting said first filter output to the lesser of said first filter output and said second filter output.

17. A method as claimed in claim 14, wherein the blocks of time are defined by a sliding window over time.

18. A method as claimed in claim 14, wherein the blocks of time comprise successive blocks of time.

* * * * *